US005729655A

United States Patent [19]

Kolesnik et al.

[11] Patent Number: 5,729,655

[45] Date of Patent: Mar. 17, 1998

[54] METHOD AND APPARATUS FOR SPEECH COMPRESSION USING MULTI-MODE CODE EXCITED LINEAR PREDICTIVE CODING

[75] Inventors: Victor D. Kolesnik; Andrey N. Trofimov; Irina E. Bocharova; Victor Yu Krachkovsky; Boris D. Kudryashov; Eugeny P. Ovsjannikov; Boris K. Trojanovsky; Sergei I. Kovalov, all of St. Petersburg, Russian Federation

[73] Assignees: Alaris, Inc., Fremont; G.T. Technology, Inc., Saratoga, both of Calif.

[21] Appl. No.: 716,771

[22] Filed: Sep. 24, 1996

Related U.S. Application Data

[63] Continuation of Ser. No. 251,471, May 31, 1994, Pat. No. 5,602,961.

[51] Int. Cl.[6] ..... G10L 3/02

[52] U.S. Cl. ..... 395/2.32; 395/2.28; 395/2.71; 395/2.73

[58] Field of Search ..... 395/2.28–2.39, 395/267, 2.71–2.74, 2.91–2.95

[56] References Cited

U.S. PATENT DOCUMENTS

| | | | |
|---|---|---|---|
| 4,472,832 | 9/1984 | Atal et al. | 381/40 |
| 4,736,428 | 4/1988 | Deprettere et al. | 381/38 |
| 4,790,016 | 12/1988 | Mazor et al. | 381/36 |
| 4,817,157 | 3/1989 | Gerson | 381/40 |
| 4,868,867 | 9/1989 | Davidson et al. | 381/36 |
| 4,896,361 | 1/1990 | Gerson | 381/40 |
| 4,912,764 | 3/1990 | Hartwell et al. | 381/38 |
| 4,914,701 | 4/1990 | Zibman | 381/36 |
| 4,924,508 | 5/1990 | Crepy et al. | 381/38 |
| 4,932,061 | 6/1990 | Kroon et al. | 381/30 |
| 4,944,013 | 7/1990 | Gouvianakis et al. | 381/38 |
| 4,969,192 | 11/1990 | Chen et al. | 381/31 |
| 4,980,916 | 12/1990 | Zinser | 381/36 |
| 5,012,518 | 4/1991 | Liu et al. | 381/42 |
| 5,060,269 | 10/1991 | Zinser | 381/38 |
| 5,073,940 | 12/1991 | Zinser et al. | 381/47 |
| 5,177,799 | 1/1993 | Naitoh | 381/34 |
| 5,187,745 | 2/1993 | Yip et al. | 381/36 |
| 5,195,137 | 3/1993 | Swaminathan | 381/29 |

(List continued on next page.)

OTHER PUBLICATIONS

WESCANEX 93: Communications, Computers & Power in the Modern Environment, "Codebook Searching for 4.8 kbps CELP Speech Coder", by Grieder et al, 17–18 May 1993 pp. 397–406.

(List continued on next page.)

*Primary Examiner*—Kee M. Tung

*Attorney, Agent, or Firm*—Blakely, Sokoloff, Taylor & Zafman LLP

[57] ABSTRACT

An apparatus and method of coding speech. The apparatus includes a first circuit being coupled to receive a first signal, the first signal corresponds to the speech signal. The first circuit is for generating a first set of parameters corresponding to the first frame. The apparatus includes a second circuit, being coupled to receive a second signal and the first set of parameters, the second signal corresponding to the speech signal, and the second circuit is for generating a third signal. The apparatus further includes a pulse train analyzer, being coupled to the second circuit, for generating a third match value, a third set of parameters, and a third excitation value. The apparatus further including a fourth circuit, being coupled to the second circuit, for generating a fourth match value, a fourth set of parameters, and a fourth excitation value. The apparatus further including a fifth circuit, being coupled to the third circuit and the fourth circuit, for selecting a mode corresponding to a match value. The apparatus further including a sixth circuit, being coupled to the fifth circuit, for selecting a selected set of parameters and a selected excitation corresponding to the mode. The apparatus further including a seventh circuit, being coupled to the first circuit and the sixth circuit, for generating an encoded signal responsive to the selected set of parameters and the mode.

25 Claims, 10 Drawing Sheets

U.S. PATENT DOCUMENTS

| | | | |
|---|---|---|---|
| 5,199,076 | 3/1993 | Taniguchi et al. | 381/36 |
| 5,222,189 | 6/1993 | Fielder | 395/2 |
| 5,233,659 | 8/1993 | Ahlberg | 381/30 |
| 5,235,671 | 8/1993 | Mazor | 395/2 |
| 5,255,339 | 10/1993 | Fette et al. | 395/2 |
| 5,369,724 | 11/1994 | Lim | 395/2.15 |
| 5,388,181 | 2/1995 | Anderson et al. | 395/212 |
| 5,394,508 | 2/1995 | Lim | 395/2.38 |
| 5,414,796 | 5/1995 | Jacobs et al. | 395/2.31 |

OTHER PUBLICATIONS

Malone, et al. "Trellis–Searched Adaptive Prediction Coding," IEEE (Dec. 1988), pp. 0566–0570.

Malone, et al. "Enumeration and Trellis Searched Coding Schemes for Speech LSP Parameters," IEEE (Jul. 1993), pp. 304–314.

Campbell, Joseph P. Jr. "The New 4800 bps Voice Coding Standard," Military & Government Speech Tech '89 (Nov. 14, 1989), pp. 1–4.

Atal, Bishnu S. "Predictive Coding of Speech at Low Bit Rates," IEEE Transactions on Communications (Apr. 1982), vol. Com–30, No. 4, pp. 600–614.

Davidson, Grant. "Complexity Reduction Methods for Vector Excitation Coding," IEEE (1986), pp. 3055–3058.

Lynch, Thomas J. "Data Compression Techniques and Applications," Van Nostrand Reinhold (1985), pp. 32–33.

Babkin, V.F., "A Universal Encoding Method With Nonexponential Work Expenditure for a Source of Independent Messages," Translated from Problemy Peredachi Informatsii, vol. 7, No. 4, pp. 13–21, Oct.–Dec. 1971, pp. 288–294.

Richard L. Zinser, Steven R. Koch, Celp Coding at 4.0 kb/sec and Below: Improvements to FS–1016, IEEE, 1992m ogs I–313–1316.

Peter Lupini, Neil B. Cox, Vladimir Cuperman, A Multi–Mode Variable Rate Celp Coder Based on Frame Classification, pp. 406–409.

Shihua Wang, Allen Gersho, Improved Phonetically–Segmented Vector Excitation Coding at 3.4kb/s, IEEE 1992, pp. I–349–I1352.

Zhang Xiongwei, Chen Zianzhi, A New Excitation Model for LPC Vocoder at 2.4 kb/s, pp. I65–I68.

Y. J. Liu, On Reducing the Bit Rate of a Celp–Based Speech Coder, IEEE 1992, pp. I49–I52.

Yunus Hussain, Nariman Farvarding, Finite–State Vector Quantization Over Noisey Channels and Its Application to LSP Parameters, IEEE 1992, pp. II–133–II–136.

Jesper Haagen, Henrik Neilsen, Steffen Duus Hansen, Improvements in 2.4 kbps High–Quality Speech Coding, IEEE 1992, pp. II–145–II–148.

METHOD AND APPARATUS FOR SPEECH COMPRESSION USING MULTI-MODE CODE EXCITED LINEAR PREDICTIVE CODING

This is a continuation of application Ser. No. 08/251,471, filed May 31, 1994 U.S. Pat. No. 5,602,961.

BACKGROUND OF THE INVENTION

1. Field of Invention

The present invention generally relates to speech coding at low bit rates (in a range 2.4–4.8 kb/s). In particular, the present invention relates to improving excitation generating and linear predicting coefficient coding directed at the reduction of the number of data bits for coded speech.

2. Description of Related Art

Digital speech communication systems including voice storage and voice response facilities utilize signal compression to reduce the bit rate needed for storage and/or transmission. As it is well known in the art, a speech pattern contains redundancies that are not essential to its apparent quality. Removal of redundant components of the speech pattern significantly lowers the number of bits required to synthesize the speech signal. A goal of effective digital speech coding is to provide an acceptable subjective quality of synthesized speech at low bit rates. However, the coding must also be fast enough to allow for real time implementation.

One method used to partially achieve these goals is based on the standard Linear Prediction (LP) technique. The characteristic features of this technique are the following. The sampled and quantized speech signal is partitioned into successive intervals (frames), then a set of parameters representative of the interval speech is generated. The parameter set includes linear prediction coefficients (LPCs) which determine an LP filter, and the best excitation signal. The best LPCs and excitation are then used to produce a synthesized signal close to the original speech signal. This is done on a per frame basis.

The best excitation is typically found through a look-up in a table, or codebook. The codebook includes vectors whose components are consecutive excitation samples. Each vector contains the same number of excitation samples as there are speech samples in a frame.

One of the most effective approaches of this type is the Code Excited Linear Prediction (CELP) method which was disclosed in "Predictive Coding of Speech at Low Bit Rates", Atal B. S., IEEE Transactions on Communications, vol. COM-30, No. 4, (April, 1982), 600–614.

FIG. 1 illustrates how a CELP implementation generates the best excitation for an LP filter such that the output of the filter closely approximates input speech.

In each frame the input speech signal is pre-filtered by a fixed digital pre-filter 100. Next, the pre-filtered speech is processed by linear prediction analyzer 101 to estimate the linear predictive filter A(z) of a prescribed order. Each frame is broken into a predetermined number of subframes. This allows excitations to be generated for each subframe. Each speech vector, for a given subframe, is passed through the ringing removal and perceptual weighting module 102. The speech signal is perceptually predistorted by a linear filter with the transfer function $W(z)=A(z)/A(\gamma z)$ for some $\gamma$. The output w, of module 102, is analyzed by the long-term prediction analyzer 103 to obtain a periodic (pitch) component p relating to the excitation. The best pitch excitation is found by searching the index (code word number) $I_A$ in an adaptive codebook (ACB) and computing the optimal gain factor $g_A$. These jointly minimize the squared norm $\|d\|^2$ of the vector $d=w-bg_A$, where b denotes the response of the synthesis filter $1/A(z\gamma)$ 104 excited by p. For this purpose, an exhaustive search in an ACB is performed to find the maximal value of the match function:

$$M=(w,b)^2/(b,b).$$

The optimal gain value is determined as follows:

$$g_A=(w,b)/(b,b).$$

The residual vector $u=w-b\,g_A$ from the output of adder 105 enters the stochastic codebook analyzer 108. Here the best residual excitation index $I_S$, and the optimal gain factor $g_s$, are found. These jointly minimize the squared norm $\|d\|^2$ of the error vector $d=u-rg_s$, where r denotes the response of the stochastic codebook analyzer 108's synthesis filter excited by the code word c, from the precomputed stochastic codebook 109. Using the multiplier 106, multiplier 110, and adder 107, we obtain the resulting excitation vector e for a given subframe as the following sum:

$$e=pg_A+cg_s.$$

For the CELP speech coding technique, the synthesized speech quality rapidly degrades as data rates are reduced. For example, at 4.8 kb/s, a 10-bit codebook is generally used. However, at 2.4 kb/s, the number of bits of the codebook must be decreased to 5. Since 5 bits are too small to cover many types of speech signals, the speech quality is abruptly degraded at a bit rate lower than 4.8 kb/s.

Various improvements of the CELP technique exist. These techniques attempt to provide acceptable speech compression at data rates below 4800 bps. Such techniques are reported in the following references:

- Zinser R. L., Koch S. R. "CELP coding at 4.0 kb/sec and below: improvements to FS-1016." Proceedings of the 1992 IEEE International Conference on Acoustics, Speech, and Signal Processing, pp. I-313 through I-316, March 1992;
- Wang S., Gersho A. "Improved phonetically-segmented vector excitation coding at 3.4 kb/s." Proceedings of the 1992 IEEE International Conference on Acoustics, Speech, and Signal Processing, pp. I-349 through I-352, March 1992;
- J. Haagen, H. Nielsen, S. D. Hansen "Improvements in 2.4 kb/s high-quality speech coding." Proceedings of the 1992 IEEE International Conference on Acoustics, Speech, and Signal Processing, pp. II-145 through II-148, March 1992;
- R. L. Zinser "Hybrid switched multi-pulse/stochastic speech coding technique." U.S. Pat. No. 5,060,269;
- Z. Xiongwei and Chen Xianzhi "A new excitation model for LPC voceder at 2.4 Kb/s." Proceedings of the 1992 IEEE International Conference on Acoustics, Speech, and Signal Processing, pp. I-65 through I-68, March 1992;
- Federal Standard 1016, "Telecommunications: Analog to Digital Conversion of radio voice 4,800 bit/second Code Excited Linear Prediction (CELP)." February, 1991.

These CELP-based systems reduce the bit rate by: 1) reducing the number of bits for excitation coding by using more simple excitations than in CELP; or 2) reducing the number of bits for LPC coding by more complicated vector quantization, with a corresponding loss in the subjective quality.

Use of the excitation classes other than CELP, and requiring the reduced number of bits, were investigated, for example, in "On reducing the bit rate of a CELP-based speech coder", Y. J. Liu, Proceeding of 1992 International Conference on Acoustics, Speech and Signal Processing, pp. I-49 through 1-52, March 1992. It was shown there that the signal-to-noise ratio (SNR) for the half-rate CELP-based system is lower by 3–4 dB in comparison with the SNR of the Federal 4800 bps CELP Standard.

To decrease the number of bits for LPC coding, a number of methods were proposed in prior art, as for example in U.S. Pat. Nos. 5,255,339, 5,233,659. The most effective approaches of this type are split-vector quantization, disclosed in "Efficient Vector Quantization of LPC Parameters at 24 bits/frame," K. K. Paliwal and B. S. Atal, Proceedings of the 1991 IEEE International Conference on Acoustics, Speech and Signal Processing, pp. 661–664, May 1991, and the finite-state vector quantization, was described in "Finite-state Vector Quantization over Noisy Channels and its Application to LSP Parameters", Y. Hussain and N. Farvardin, Proceedings of the 1992 IEEE International Conference on Acoustics, Speech and Signal Processing, pp. II-133 through II-136, March 1992. For these processes, 24–26 bits/frame are needed for quantization with a quality close to that in CELP. However, a further decrease in the number of bits leads to a loss in the quality. Also, these quantization schemes are much more complicated in comparison with the 34 bits scalar quantizer in CELP Standard.

An effective speech compression at rates in a range 2.4 through 4.8 kb/s, with an acceptable quality of synthesized speech, and a practical real time implementation still remains as a key problem.

An improved method and apparatus for compressing speech is desired.

SUMMARY OF THE INVENTION

An improved method and apparatus for compressing speech is described. One goal of the present invention is to provide high quality speech coding at data rates approximately between 2400–4800 bits per second. Another goal is to provide such a system that also satisfies time and memory requirements of a real time hardware implementation.

In one embodiment, the following three search modes, for excitation vector generating, are used: 1) a pulses search (Pulse); 2) a full adaptive codebook search (ACB), and 3) a shortened adaptive codebook search coupled with a stochastic codebook search (SACBS). The use of these search modes reduces the number of bits required for excitation coding.

Another embodiment includes a method for constructing specially shaped pulses. The specially shaped pulses have spectrums matched with linear prediction filter parameters to improve the subjective speech quality of the synthesized speech. This technique provides a plurality of excitation forms without using additional bits for excitation coding.

Another embodiment of the invention includes a low-complexity predictive coding process for LPCs. The process includes linear prediction of LSPs followed by LSP-differences variable rate coding. This embodiment has the advantage of providing a lower data rate without degrading the LSP representation accuracy.

In another embodiment, a multi-mode code excited linear predictive (MM-CELP) speech coding lowers the data rate further. The lower data rate is achieved without substantially increasing the computational time, and complexity, of the encoding. The quality of MM-CELP synthesized speech, at a rate ≦2400 bps, works well for normal uses of encoded speech.

Although a great deal of detail has been included in the description and figures, the invention is defined by the scope of the claims. Only limitations found in those claims apply to the invention.

BRIEF DESCRIPTION OF THE DRAWINGS

The present invention is illustrated by way of example, and not limitation, in the figures. Like references indicate similar elements.

DESCRIPTION OF THE PREFERRED EMBODIMENT

Overview

Figure 1:
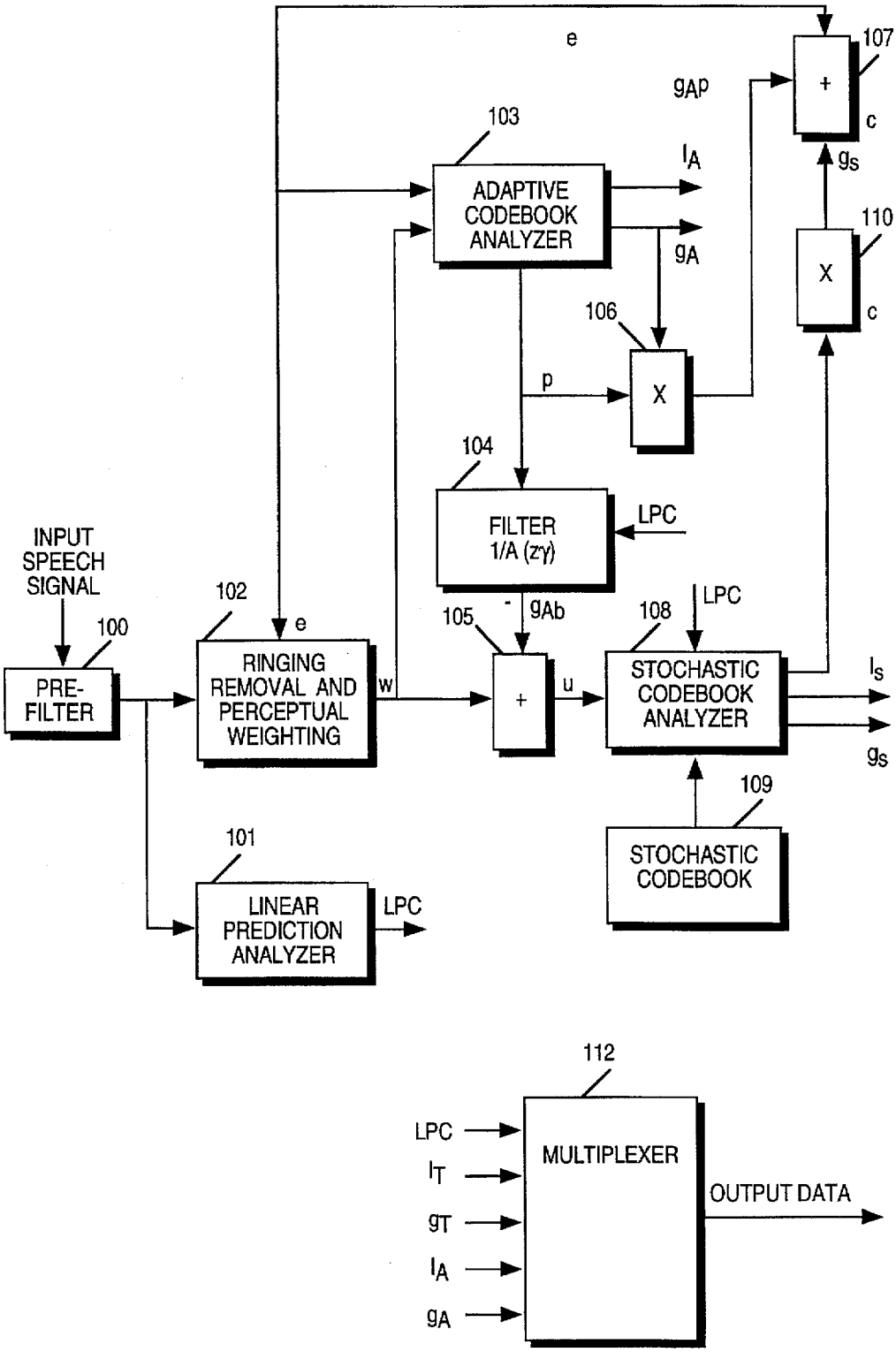
FIG. 1 (PRIOR ART)
FIG. 1 (prior art) is a block diagram of CELP speech analyzer.

An improved method and apparatus for compressing speech are described. In the following description, numerous specific details are set forth such as weighting values, mode selections, etc., in order to provide a thorough understanding of the present invention. It will be obvious, however, to one skilled in the art that the present invention may be practiced without these specific details. In other instances, well-known circuits, structures and techniques have not been shown in detail in order not to unnecessarily obscure the present invention.

Applications of Compressed Speech

The present invention has application wherever speech compression or synthesized speech is used. Speech compression compresses the speech into as small a representation of the speech as possible. Speech synthesis reconstructs the compressed speech into as close a representation of the original speech as possible. Speech compression is used in voice communications, multimedia computer systems, answering machines, etc. Speech synthesis may be used in toys, games, computer systems, and so on.

In some applications, the compressed speech will be created on one system and reproduced on another. For example, a game, or toy, with predetermined audible responses, will only decode synthesized speech. Thus, given the description herein, one skilled in the an will understand that the present invention can be used in any application requiting speech compression or synthesized speech.

Multi-Mode Celp (MM-Celp) Speech Analyzer Overview

Compared to the Code Excited Linear Prediction (CELP) analyzer, one embodiment of the present invention reduces the number of bits needed for speech storing, or transmitting, without a significant loss in the subjective speech quality. These advantages are achieved by: using three different excitation search modes, instead of two modes employed in CELP, together with a special strategy of mode selection, and by using an efficient LPC coding.

In CELP, two modes (Adaptive codebook search and Stochastic codebook search) are searched for each subframe. The present speech compression technique uses the best selected candidate from a set of admissible modes that is formed on the basis of three different modes. The number of bits is reduced, compared with CELP, since only one mode is used for each subframe. As well, we improve speech quality by using a greater number using a greater number of excitation forms.

In one embodiment, a set of admissible modes is determined based upon the mode used in the previous subframe. In another embodiment, the mode requiring the lowest number of bits is tested first. In another embodiment, the use of weighting coefficients are used to weight the selection of a mode, making some modes more likely than others.

In another embodiment, a substantial improvement of the system performance is obtained by effective variable rate encoding of predictive filter parameters and by a new method of constructing specially shaped pulses used in a pulse excitation mode.

Throughout the following description, many signals are processed using a number of filters, circuits, and lookup tables. Each of these can be implemented in any number of physical devices. For example, look-up tables can be implemented using DRAM or SRAM and control circuitry. Filters, for example, can be implemented in hardware (such as PLAs, PALs, PLDs, ASICs, gate-arrays) or software. Given the description of each of the devices herein, one of ordinary skill in the art would understand how to build such devices.

Block Diagram of A Multi-Mode CELP Speech Analyzer

Figure 2A:
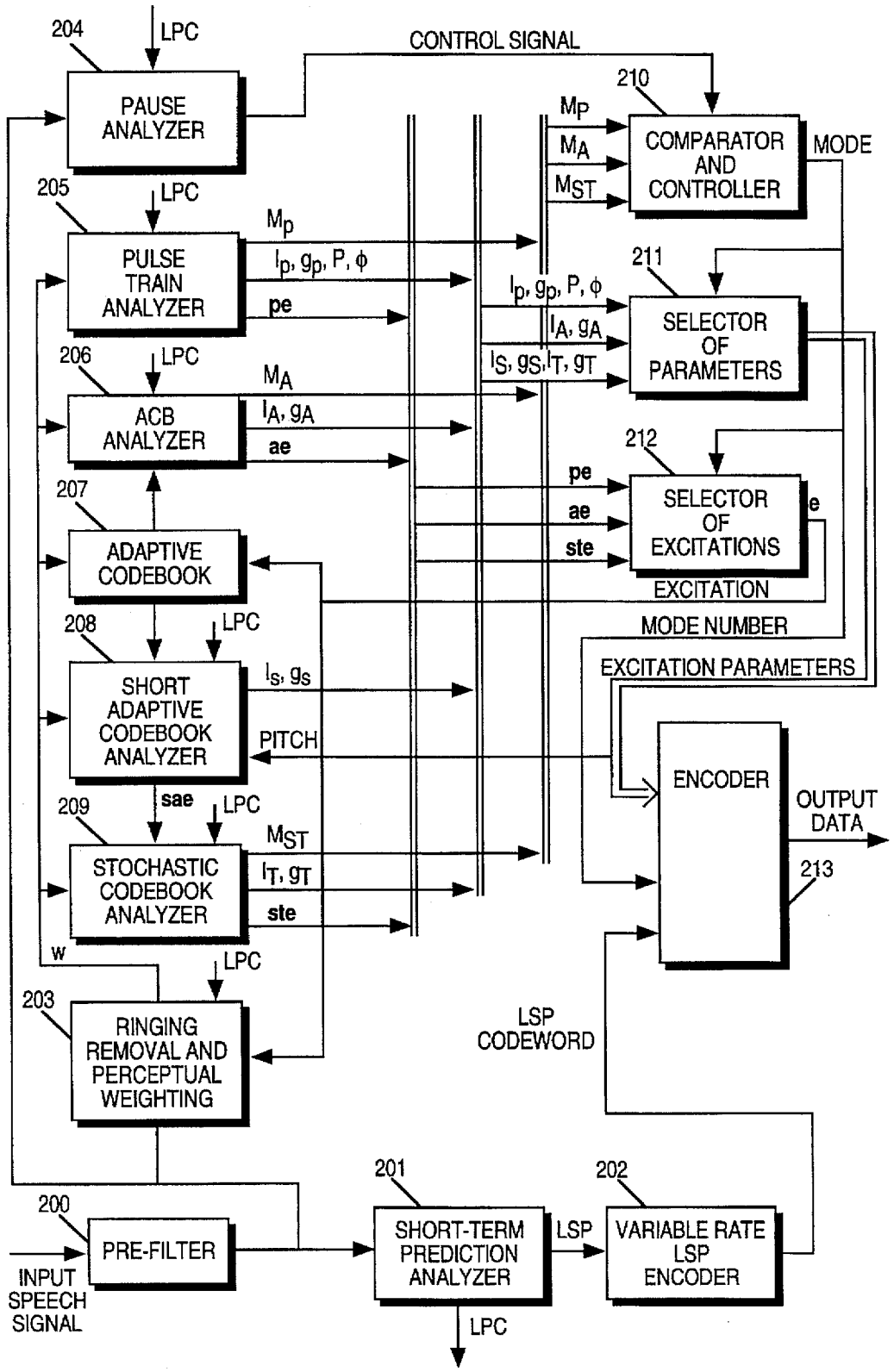
FIG. 2A is a block diagram of a speech analyzer utilizing Multi-Mode Code Exciting and Linear Prediction (MM-CELP).

The block diagram in FIG. 2A shows an implementation of a Multi-Mode CELP (MM-CELP) speech analyzer. Details relating to the analog to digital conversions are omitted as one of ordinary skill in the an would understand how to effect such conversions given the description herein. The digital speech signal, which is typically sampled at 8 KHz, is first processed by a digital pre-filter 200. The purpose of such pre-filtering, coupled with the corresponding post-filtering, is to diminish specific synthetic speech noise. See Ludeman, Lonnie C., "Fundamentals of Digital Signal Processing," New York, N.Y.: Harper and Row, 1986, for further background on pre-filtering and post-filtering.

Pre-filtered speech is analyzed by short-term prediction analyzer 201. Short-term prediction analyzer 201 includes a linear prediction analyzer, a converter from linear prediction coefficients (LPC) into line spectrum pairs (LSPs) and a quantizer of the LSPs. For each frame, linear prediction analyzer 201 produces a set of LPCs $a_1, \ldots, a_m$ which define the LP analysis filter of a prescribed order m (called a short-term prediction filter):

$$A(z)=1-a_1z^{-1}-a_2z^{-2}-\ldots-a_mz^{-m}.$$

Generally, a filter order of 10 or more is acceptable. Typically, the linear prediction analysis is performed for each speech frame (about a 30 millisecond duration). The LPCs for each subframe can be produced by a well known interpolation technique from the LPCs for each frame. This interpolation is not necessary, however, it does improve the subjective quality of the speech.

The LPCs for each frame are convened into m line spectrum frequencies (LSF), or line spectrum pairs (LSP), by LPC-to-LSP conversion. This conversion technique is described, for example, in "Application of Line-Spectrum Pairs to Low-Bit-Rate Speech Encoders", by G. S. Kang and L. J. Fransen, Naval Research Laboratory, at Proceedings ICASSP, 1985, pp. 244–247. Independent, nonuniform scalar quantization of line spectrum pairs is performed by the LSP quantizer. The quantized LSP output, of short-term prediction analyzer 201 is processed through the variable rate LSP encoder 202, into codewords of a predetermined binary code. The code has a reduced number of spectral bits, for transmission into a channel or memory.

The frame, consisting of N samples, is partitioned into subframes of L samples each. Therefore the number of subframes in a frame is equal to N/L. The remaining speech analysis is performed on a subframe basis. In a typical implementation, the number of subframes is equal to 2, 3, 4, 5 or 6.

In one embodiment, the tinging removal and perceptual weighting module 203, is the same as that described in CELP. This unit performs two functions. First, it removes ringing caused by the past subframe synthesized speech signals. This function results in the ability to process speech vectors for different subframes independently of each other. Second, ringing removal and perceptual weighting module 203 performs the perceptual weighting of speech spectral components. The main purpose of perceptual weighting is to reduce the level of the synthesized speech noise components lying in the most audible spectral regions between speech formants. (A formant is a characteristic frequency, a resonant frequency, of a person's voice). As in CELP, perceptual weighting is realized by passing the prefiltered speech signals through the weighting filter (WF)

$$w(z)=A(z)/A(\gamma z),$$

with a parameter $\gamma$, taken from a range between 0.8 and 1.0. The output, w, of ringing removal and perceptual weighting module 203 is the perceptually predistorted speech.

To construct the excitation vectors for the synthesis linear predictive filter $1/A(z)$, the following three search modes are used: the full adaptive codebook search (ACB); the pulses search (Pulse); the shortened adaptive codebook search coupled with the stochastic codebook search (SACBS). First, the "best" excitation (in the sense of maximizing a match function) is found for each search mode and then the "best" excitation among selected candidates is searched. The match function is defined as follows:

$$M=(w,f)/(f,f),$$

where $f=f(e)$ denotes the excitation candidate filtered by a zero-state response filter $1/A(z\gamma)$. Maximizing match function M is equivalent to minimizing the Euclidean distance between the predistorted speech w, and filtered (and scaled by gain factor) excitation f. So, this procedure provides the maximum of the perceptual weighted signal to noise ratio.

The output w, of the ringing removal and perceptual weighting module 203, is passed to the pulse train analyzer 205, the ACB analyzer 206, the short adaptive codebook analyzer 208, and the stochastic codebook analyzer 209.

The pulse train analyzer 205, generates a list of specially shaped pulses. It also determines the best pitch (P), the best starting position (phase $\phi$), the best gain (gp) and the index of the best specially shaped impulse ($I_P$) for the multiple pitch spaced pulses excitation. The outputs of the pulse train analyzer 205 are the best excitation vector pe, its parameters ($I_P$, $g_P$, P, $\phi$), and the maximal value of match function $M_P$.

Note however, that if bit rates of approximately 4000 bps are permissible, in a given application of the present embodiment, then other pulse trains may be used rather than specially shaped pulses. For example, a pulse train having pulses positioned at specific points and with specific amplitudes can be used. The set of parameters includes ($g_{pi}$,$t_i$),i=1,2, . . . , k, where $g_{pi}$ denotes the gain of the i-th pulse of the pulse train and ti denotes the position of the i-th pulse, k is the number of pulses in the pulse train.

The ACB analyzer 206 is implemented as it was described for the CELP Standard FS-1016. The adaptive codebook 207 includes excitations e used for previous subframes. For a given subframe, ACB analyzer 206 generates the best adaptive codebook excitation, ae, its corresponding index value ($I_A$) in adaptive codebook 207, and a gain $g_A$. ae represents the excitation vector that maximizes the match function $M_A$.

Short adaptive codebook analyzer (SACB) 208 differs from ACB analyzer 206 in searching for the best excitation. SACB determines its best (sae), the corresponding index ($I_S$), and gain ($g_S$), through a subset of the adaptive codebook 207 called the shortened ACB. In this case, the index ($I_S$) and the gain ($g_S$) have a reduced quantization scale. The shortened ACB includes past excitation vectors, however, the indices are neighbors of the pitch value found in the previous subframe analysis (previous output of the selector 211). This pitch value is determined as follows:

$$\text{Pitch} = \begin{cases} P, \text{ if the previous Mode} = \text{Pulse} \\ \text{Pitch}(I_A), \text{ if previous Mode} = ACB \\ \text{Pitch}(I_S), \text{ if previous Mode} = SACBS, \end{cases}$$

where Pitch($I_A$) and Pitch($I_S$) are some functions mapping integer values $I_A$ and $I_S$ onto a set of the available pitch values.

The best shortened ACB excitation vector sac, scaled by factor $g_S$, is processed by the stochastic codebook (SCB) analyzer 209 to reduce the difference between the SACB module output and the perceptual predestined speech vector w. In one embodiment, the stochastic codebook (SCB) analyzer 209 is the same as in the CELP standard.

To reduce the computational complexity of the search through the SCB, SCB analyzer 209 may be implemented as a trellis codebook, as was disclosed in Kolesnik et. al. "A Speech Compressor Using Trellis Encoding and Linear Prediction", U.S. patent application Ser. No. 08/097,712, filed Jul. 26, 1993. Such a computational complexity reduced system is referred to as a Multi-Mode Code Exciting and Linear Prediction (MM-TELP) speech encoding system.

Stochastic codebook analyzer 209 calculates the difference signal, u, between a perceptually predistorted speech vector, w, and the response of the synthesis filter $1/A(z\gamma)$ excited by $g_S$.sae. This difference signal u is approximated by a zero-state response of the SCB analyzer synthesis filter excited by a word found in the stochastic codebook. The transfer function of this filter could also be chosen as $B(z)=1/A(z\gamma)$.

The best code word, c, as well as its index, $I_T$, and optimal gain value, $g_T=g_T(u,c)$, are found by performing the decoding procedure in the SCB analyzer 209. The excitation vector ste=$g_T$c+sae, together with the SCB index $I_T$ and the optimal gain $g_T$, are transferred to the output of the stochastic codebook analyzer 209. Next, stochastic codebook analyzer 209 calculates the match function, MST, for the sum of the best scaled vectors from the shortened adaptive codebook and the SCB. The value of the match function MST is also transferred to the output of the stochastic codebook analyzer 209.

The pause analyzer 204 uses an energy test to classify each subframe to determine whether that subframe is a silent, or a voice activity, subframe. The pause analyzer 204 output controls the comparator and controller 210. In one embodiment, at a subframe, following a silent subframe, only pause or pulse search modes are allowed. For the voice activity subframe, comparator and controller 210 chooses search modes depending on the mode of the previous subframe.

Since different excitation search modes require differing numbers of bits for excitation coding, the bit rate value is variable from frame to frame. The largest number of bits is required by SACBS mode while the smallest ACB mode is required. To reduce, or to limit, the bit rate, without a substantial loss in speech quality, some restrictions on the search mode usage may be imposed optionally. Admissible modes which may be chosen depending on the previous selected modes are presented in Table 1.

TABLE 1

| Mode for Previous Subframe | Admissible Modes for Current Subframe |
|---|---|
| Pulse | Pulse, ACB, Pause |
| ACB | Pulse, SACBS, Pause |
| SACBS | Pulse, ACB, Pause |
| Pause | Pulse, Pause |

For a voice activity subframe, the comparator and controller 210 selects the search mode using the formula $$\text{Mode} - \underset{\mu}{\arg} \max_{M} \{\beta\mu M\mu\}$$

where M is a set of admissible modes, M⊆ {P, ACB, SACBS}, $M_\mu$denotes the match function for mode $\mu$, and $\beta_\mu$are weighting coefficients. These weighting coefficients effect the probability that a certain mode will be chosen for a given subframe. Through empirical study, the weighting coefficient of Table 2 have been found to provide subjectively good quality speech with a minimum average data rate.

TABLE 2

| Search mode | Weighting Coefficient |
|---|---|
| Pulse | 0.7–1.0 |
| ACB | 1.1–1.3 |
| SACBS | 0.8–1.0 |

Weighting coefficients $\beta_\mu$are introduced with two goals: a) to reduce the synthesized noise level and b) to provide more flexible bit rate adjustment.

The selector of excitations 212, and the selector of parameters 211, choose respectively, the best excitation e, and its corresponding parameters, for the selected search mode. The best excitation vector e, the output of selector of excitations 212, is used for the innovation of the ACB content, in a similar manner as the CELP standard analyzer. The excitation vector e is additionally supplied to perceptual weighting and ringing removal 203.

The excitation parameters and the search mode for each subframe, in a frame, as well as the coded LSP, for a given frame, are jointly coded by the encoder 213 and are transmitted to a receiving synthesizer, or stored in a memory.

Bit rate reduction is also achieved through the use of a superframe. A superframe consists of a few frames and can be used to restrict the number of times a mode having a large numbers of bits (e.g. SACBS and Pulse) can be used in that superframe.

Details of the Perceptual Weighting and Ringing Removal Circuit

Figure 2B:
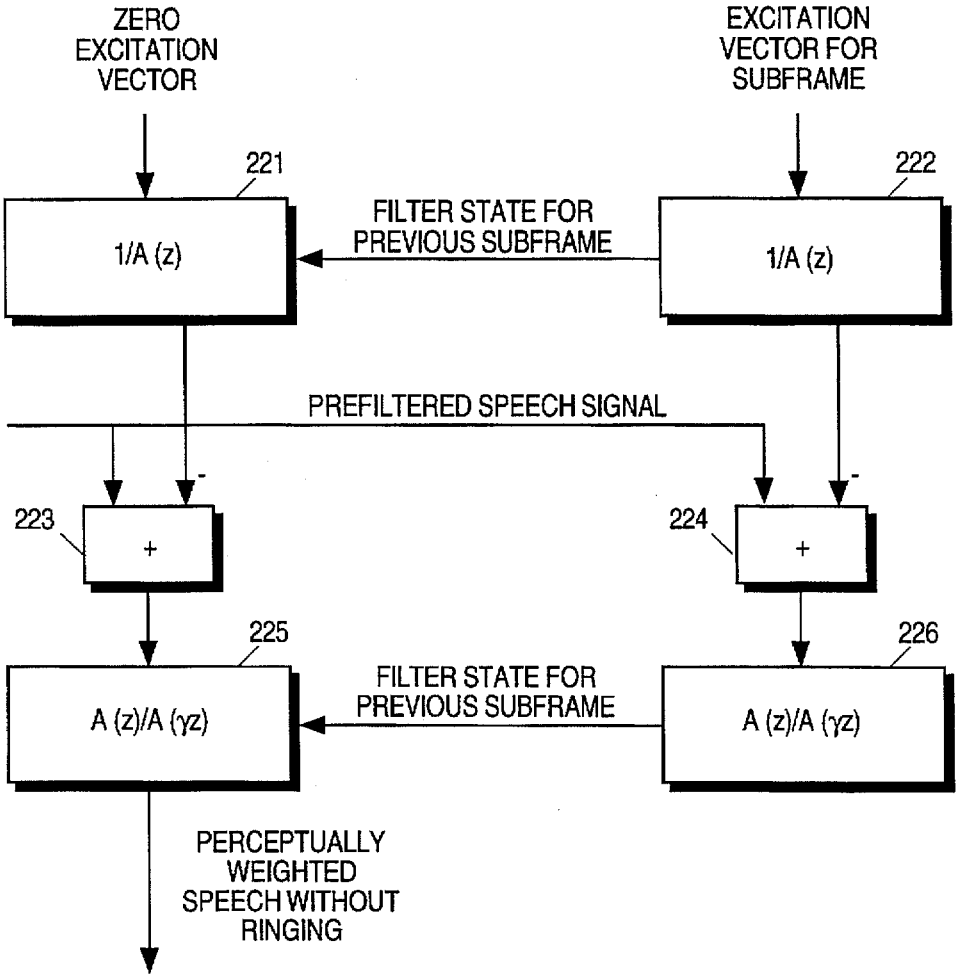
FIG. 2B is a block diagram of the perceptual weighting and ringing removal unit from the MM-CELP speech analyzer of FIG. 2A.

The tinging removal and perceptual weighting module 203, of FIG. 2A, is further described with reference to FIG. 2B. There are two synthesis filters 1/A(z) 221, 222, and two weighting filters 225, 226. The excitation vector e, from the previous subframe, is applied to the filter 222, in order to produce a synthesized speech vector for the current subframe. The zero excitation vector is applied to the filter 221, starting from the state achieved by the filter 222 to the end of the previous subframe, in order to produce the tinging vector for the current subframe. The output of the adder 224 is the approximation error vector. The output of the adder 223 is the speech vector without ringing. The approximation error vector is applied to the filter 226 starting from the state achieved to the end of the previous subframe. The filter 225 uses the same state as achieved by the filter 226 to the end of the previous subframe to produce the perceptually weighted speech vector without ringing for the current subframe.

Details of the Pulse Train Analyzer

Figure 3A:
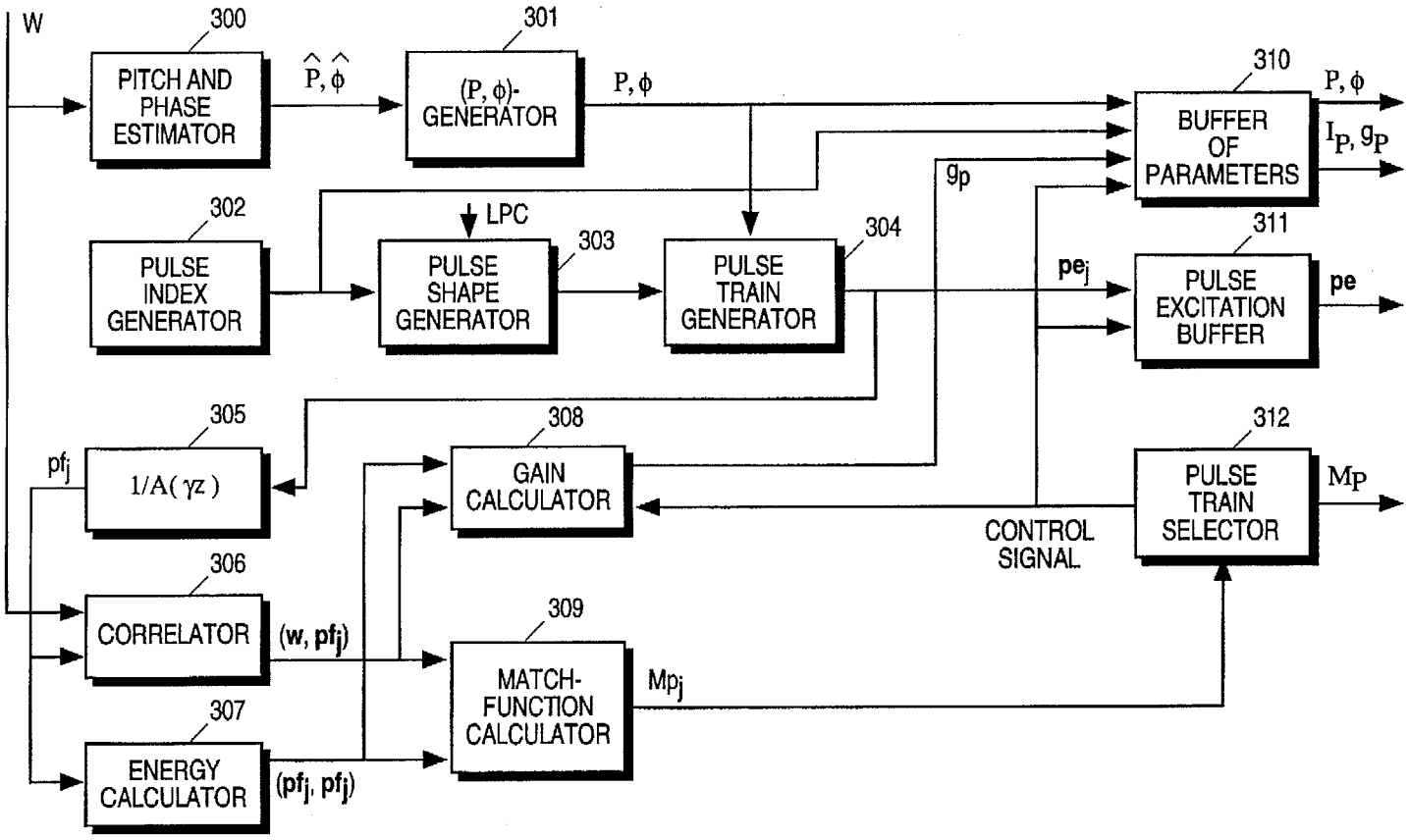
FIG. 3A is a block diagram of the pulse analyzer of FIG. 2A.
Figure 3B:
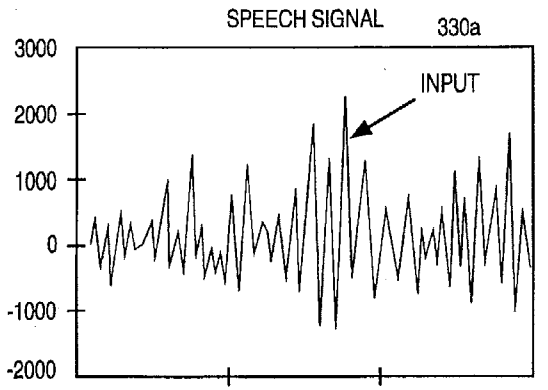
FIGS. 3B, 3C, 3D and 3E illustrate is an example of a specially shaped pulse depending on the speech waveform as may be used in one embodiment of the present invention.
Figure 3D:
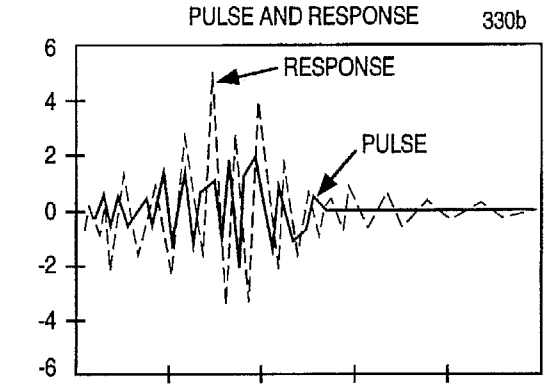
Figure 3C:
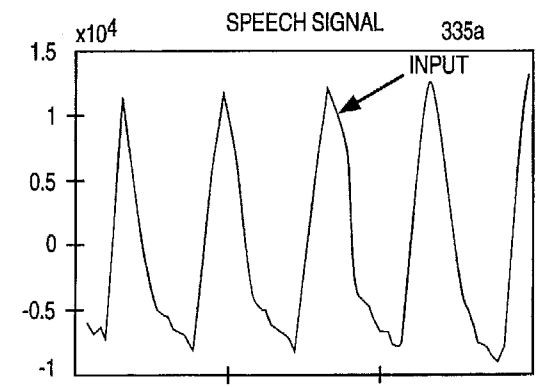
Figure 3E:
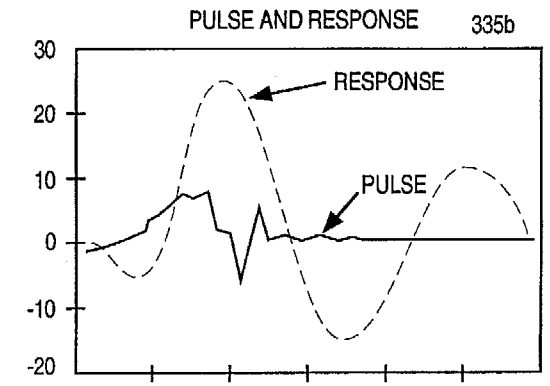

Referring now to FIG. 3A, the organization of the pulse train analyzer 205 is presented in greater detail. Here the pitch and phase estimator 300 computes initial pitch($\hat{P}$) and phase ($\hat{\phi}$) estimates by analyzing the perceptually weighted speech signal from the ringing removal and perceptual weighting module 203. These values are used as the inputs of the pitch and phase generator 301 which forms a list of the pitch and phase values in the neighborhood of ^^ and $\hat{\phi}$ respectively. The neighborhood is defined by an approximation of ^^ and $\hat{\phi}$ used to decrease the computation time needed to calculate these values.

The pulse index generator 302 prepares a list of the pulse shape indices for the pulse shape generator 303. The index value from the output of pulse index generator 302, together with the pitch and phase values from the pitch and phase generator 301, are temporarily stored in the buffer of parameters 310.

The list of pitch and phase values, together with the list of pulse indices, are used in a search for the best pulse excitation. The pulse train generator 304, employing the pitch P and phase $\phi$ values from pitch and phase generator 301, and the specially shaped pulse $v_j(\cdot)$ from pulse shape generator 303, generates the excitation vector $pe_j$ in the form of multiple pitch spaced pulses. This excitation vector may be represented as follows:

$$pe_j(t) = \sum_{i=1}^{[L/P]} v_j(t-\phi-iP-\tau_j),$$

where $v_j(\cdot)$ is the j-th specially shaped pulse. L is the subframe length. [•] denotes the maximal integer less than, or equal to, the enclosed number. $\tau_j$ is the number of central position of the j-th pulse. P is the pitch.

This vector is temporarily saved in the pulse excitation buffer 311. $pe_j$ also passes through a zero-state perceptual synthesis filter 305, to produce the filtered vector $pf_j$. For vector, $pf_j$, the correlation (w, $pf_j$) is computed in the correlator 306. The energy ($pf_j$, $pf_j$) is computed in the energy calculator 307. The match function calculator 309 uses these correlation and energy values to compute the pulse mode match function $$M_{pj}=(w,pf_j)^2/(pf_j,pf_j).$$

The pulse train selector 312 finds the maximal value of the match function $M_{pj}$ over all possible pulse trains, and produces a corresponding control signal for gain calculator 308, buffer of parameters 310, and pulse excitation buffer 311. This control signal is used for saving the best pulse excitation vector pe in the pulse excitation buffer 311, and for saving its parameters, (index, pitch, phase), in the buffer of parameters 310. The control signal from the pulse train selector 312 also allows the gain calculator 308 to generate the optimal gain value $g_P=g_{pj}$ for the best pulse train, using the formula $g_P=(w, pf_j)/(pf_j, pf_j)$.

At the end of the search, the best pulse excitation pe, as well as its parameters ($I_p$, P, $\phi$, $g_p$), and the best match function value $M_p$, are passed to the output of the pulse train analyzer 205.

Now, the implementation of the special pulse shape generator 303 is considered in more detail. The main goal of the special pulse shape generator 303 is to improve the subjective speech quality. For this purpose, the special pulse sequence $v=(v_1, v_2, \ldots, v_M)$, of length M, is used instead of an ordinary delta-pulse with uniform frequency distribution. This impulse has the spectrum matched with the synthesis filter frequency response. The specially shaped pulse v is constructed using the LP analysis filter by the following process.

Given vector $x=(x_0,x_1, \ldots)$, let $X(z)=x_0+x_1z^{-1}+\ldots$ We denote by $X_{ij}(z)$ the polynomial $X_{ij}(z)=x_iz^{-i}+x_{i+1}z^{-(i+1)}+\ldots+X_jz^{-j}, j>i$. Let $$U(z)=(1-\delta z^{-1})/A(\alpha z),$$

where A(z) denotes the transform for the LP filter, $\alpha,\delta$ are empirically chosen constants, $0\leqq\alpha,\delta\leqq 1$. Then the samples $v_0, v_1, \ldots, v_{n-1}$, $n<M$, representing the first n positions of the pulse v, are generated by the formula $V_{0,n-1}(z)=z^{n-1}U_{0,n-1}(z^{-1})$, i.e. by the time inversion of the pulse response $u=(u_0, u_1, \ldots, u_{n-1})$. To obtain the rest of the samples $v_n$, $v_{n+1}, \ldots, v_M$ we find $$W(z)=(V_{n-m,n-1}(z)+z^{-n}U_{0,d}(z))A(\beta z)$$

and put $$V_{n,M-1}(z)=W_{n,M-1}(z),$$

where $0\leqq\beta\leqq 1$ is an empirically chosen constant, $d\leqq 0$ is a fixed constant.

Coefficients $\alpha$in the range 0.9 . . . 0.98, $\delta$ in the range 0.55 . . . 0.75, and $\beta$ in the range 0.6 . . . 0.8, were chosen using a large speech database to provide acceptable subjective speech quality. The described process provides the natural synthesized speech quality, and saves bits needed for pulse index encoding in the conventional pulse codebook.

A MM-CELP Method of Encoding Speech

Figure 2C:
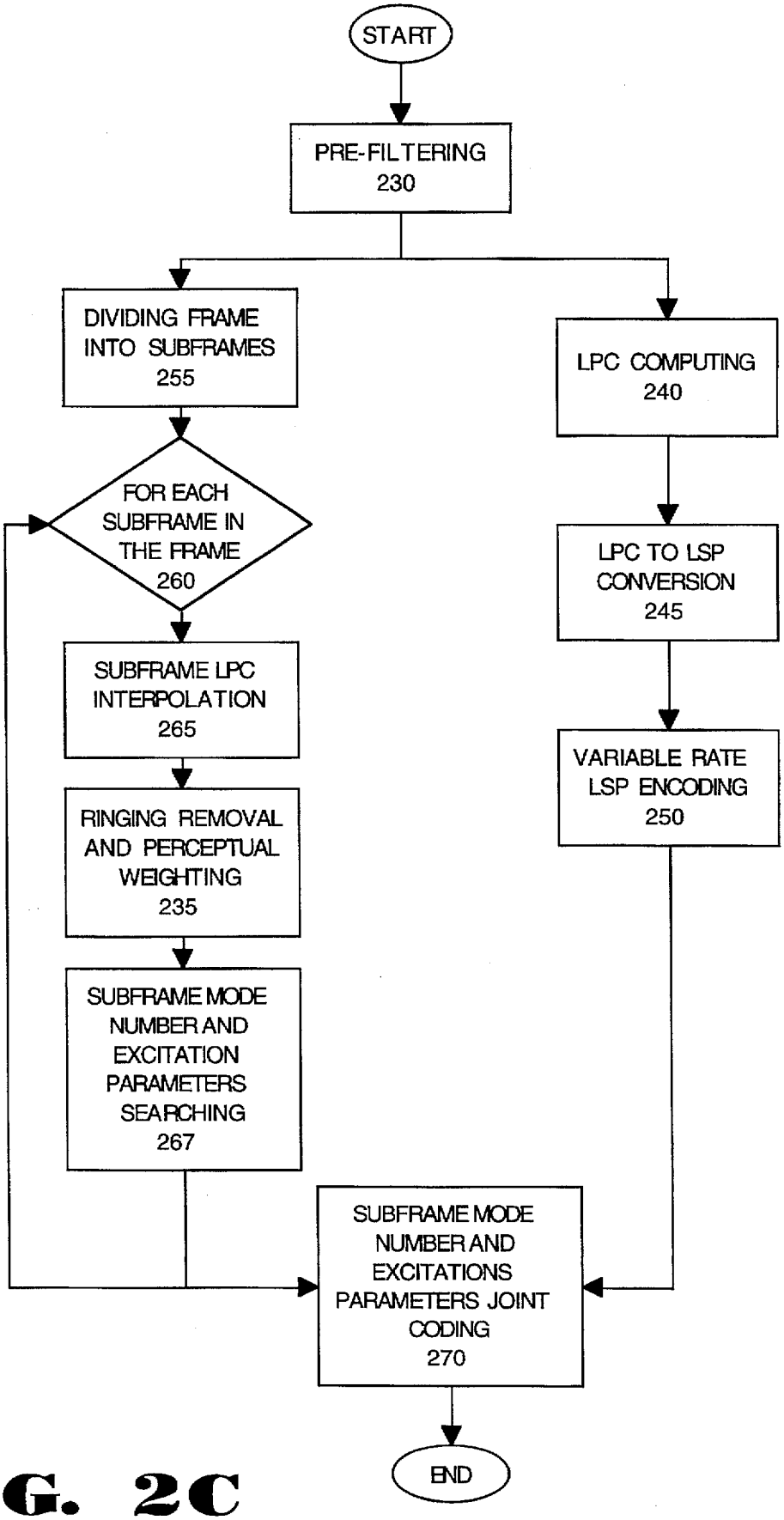
FIG. 2C is a flowchart illustrating one embodiment of a method of Multi-Mode Code Exciting and Linear Prediction (MM-CELP) speech encoding.

FIG. 2C is a flowchart illustrating one embodiment of a method of Multi-Mode Code Exciting and Linear Prediction (MM-CELP) speech encoding. It is clear from the description below, that some of these operations can be run in parallel. This invention is not limited to the order of steps presented in FIGS. 2C and 2D.

At 230, the input speech signal is pre-filtered (pre-filter 200).

At 240, the LPCs for the frame are generated in the short-term prediction analyzer 201. As well, at 245, short-term prediction analyzer, generates the LSPs for the frame. At 250, variable rate LSP encoder 202 variable rate encodes the LSPs for the frame.

At 255, the frame is divided into a number of subframes (typically four). For each subframe, the following steps are executed, 260. At 265, the LPCs for the subframe are interpolated by the short-term prediction analyzer 201. At 235, the pre-filtered signal and the LPC's are passed through a ringing removal and perceptual weighting module 203. At 267, the mode is selected from a number possible modes. The excitation parameters for that selected mode are also generated.

Once all the subframes are processed, using steps 260, 265, 235 and 267, the subframe mode numbers and excitation parameters are jointly coded with the LSP code word.

Figure 2D:
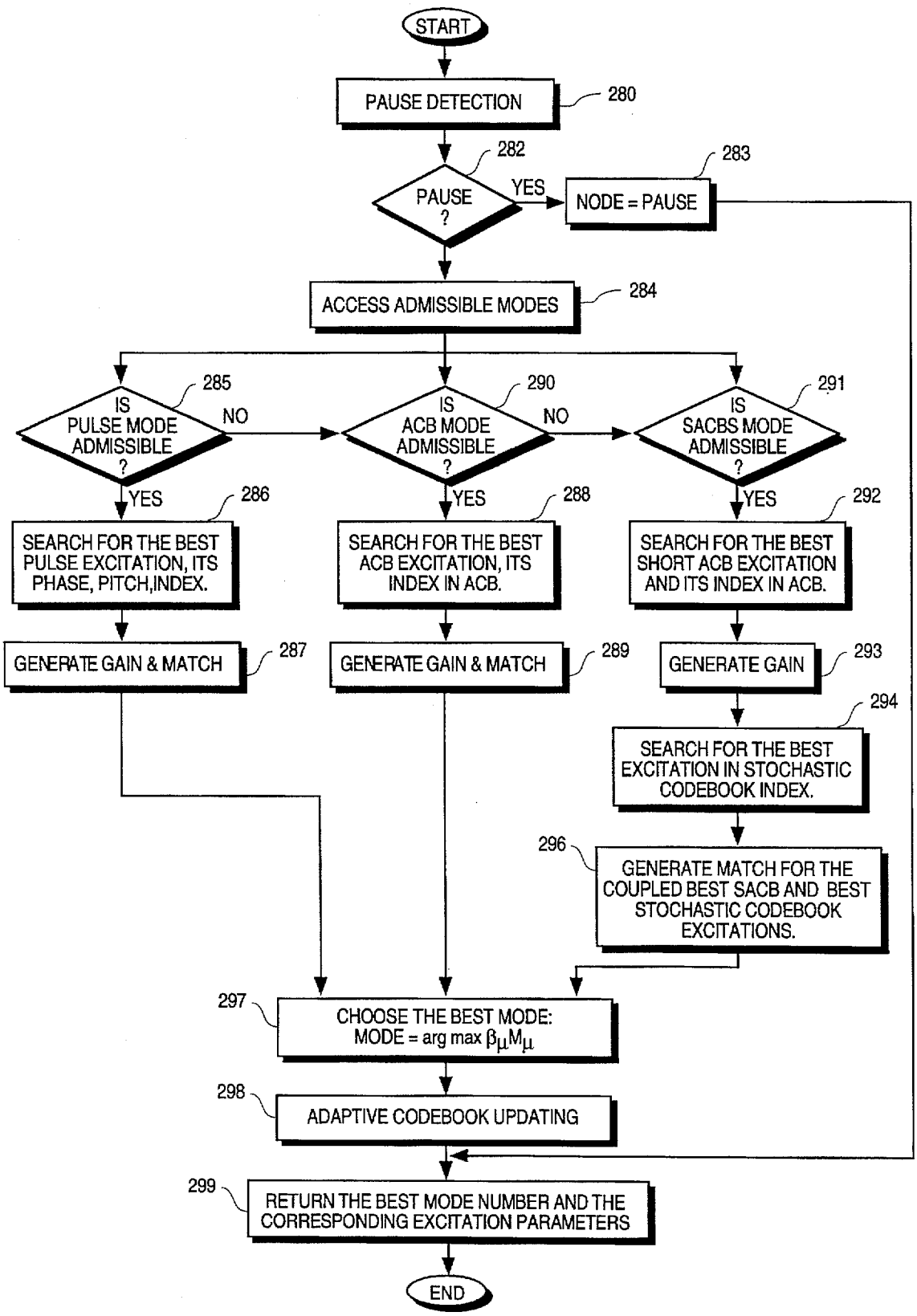
FIG. 2D is a flowchart illustrating one embodiment of a method of searching subframe mode numbers and excitation parameters.

FIG. 2D is a flowchart illustrating one embodiment of a method of searching subframe mode numbers and excitation parameters. This figure corresponds with step 267 of FIG. 2C. Note that in this figure, the execution time required for the present embodiment can be reduced by intelligently testing for a mode to correspond to the present frame. For example, the mode having the smallest number of bits (ACB) can be tested before the other modes. If the tested mode provides a sufficiently small mean-square error, the rest of the modes will not be tested.

At 280, pause analyzer 204 determines whether the input speech contains a pause. If the speech contains a pause for the subframe, 282, then the mode is set to pause, 283. Otherwise, the other various excitations and other mode information are generated 284. In one embodiment, this information is generated by a number of circuits which generate this information regardless of whether a pause is selected.

At 285, the pulse mode information, is tested for whether this subframe can be characterized as a pulse. This determination is made depending on the previous subframe's mode (see Table 1 for more information. Table 1 always allows some modes to be selected for a subframe.). If pulse mode is acceptable, then, at 286, a search is made for the best pulse excitation. The best pulse excitation's corresponding phase, pitch and index are also generated. The corresponding gain and match values are also generated, at 287.

At 290, ACB mode is tested to determine whether it is admissible. If ACB mode is admissible, then at 288, a search for the best ACB excitation, and corresponding index, is made. At 289, the corresponding gain and match values are also generated.

At 291, SACBS mode is tested to determine whether it is permitted. If the SACBS mode is pennirted, then at 292, a search for the best short ACB excitation and corresponding index is made. At 293, the gain is generated. At 294, a search for the best excitation from the stochastic codebook, and its corresponding index, is searched. At 296, a match value for the coupled best SACB and best stochastic codebook excitations is generated.

At 297, the best mode is selected from the match values provided by the various modes. The match values are also weighted prior to selection.

At 298, the adaptive codebook is updated with the excitation of the most recently selected mode. If pause is the selected mode, then the excitation from the last non-pause mode is used.

At 299, the selected mode and the corresponding excitation parameters are made available for encoding.

Examples of Specially Shaped Pulses

FIGS. 3B, 3C, 3D and 3E show some examples of specially shaped pulses and corresponding pulse responses of the synthesis filter 1/A(z). The x-axis represents time units, each unit being 1/8000 of a second. The y-axis represents an integer-valued signal magnitude. Speech signal 330*a* represents an input signal to the filter. Pulse and response 330*b* represents the corresponding pulse and response signals. Speech signal 335*a* represents a different input speech signal. Pulse and response 335*b* represents the corresponding pulse and response signals. As is clear from FIGS. 3B, 3C, 3D, and 3E for these examples, pulse shape is adopted in accordance with changes in the original speech signal.

Details of a Variable Rate LSP Encoder

Figure 4:
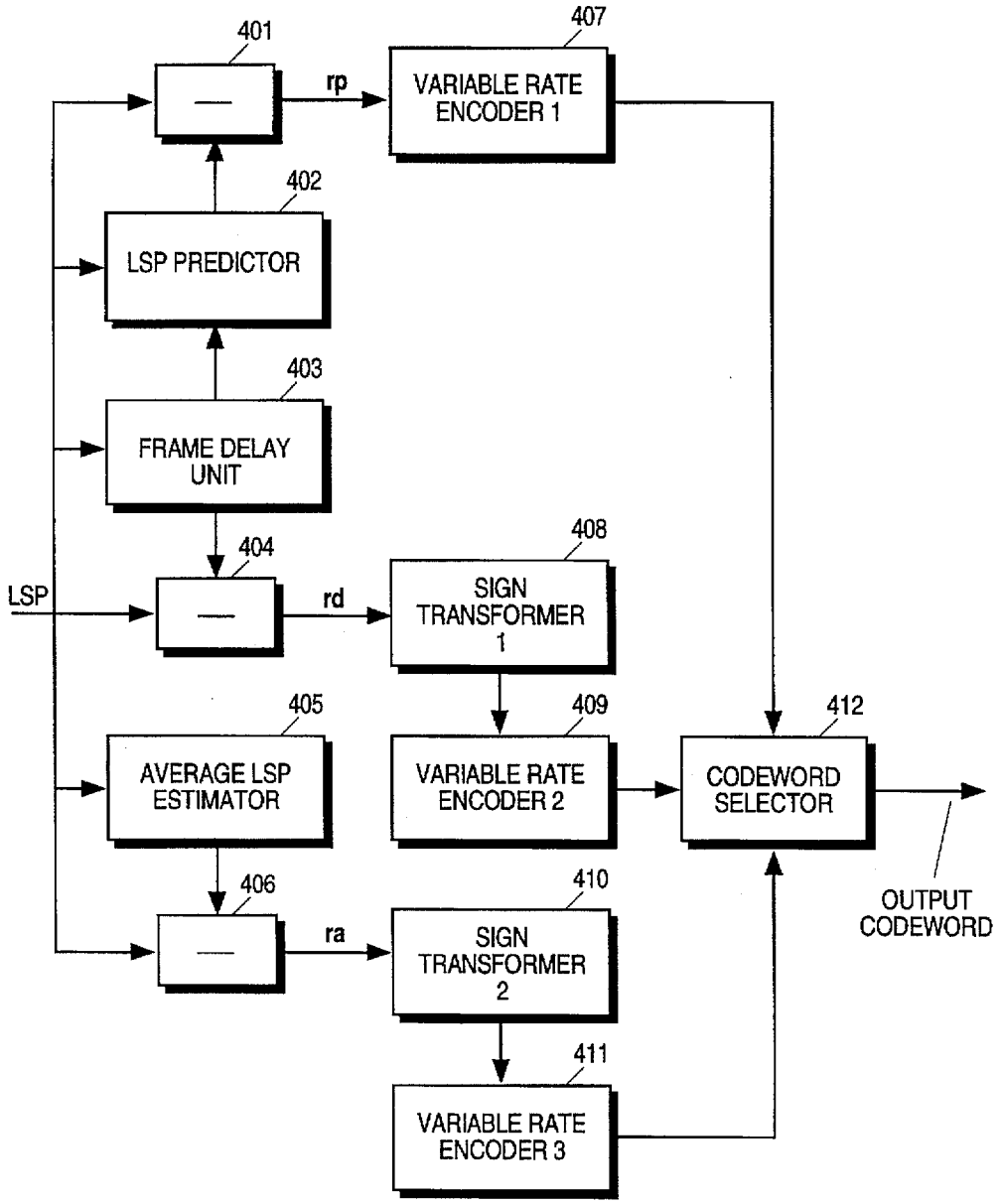
FIG. 4 is a block diagram of the LSP encoder of FIG. 2A.

FIG. 4 shows an implementation of the variable rate LSP encoder 202. The LSP encoder 202 uses m quantized LSPs and comprises three schemes for LSP predicting and preliminary coding. The first predicting and preliminary coding scheme contains the subtractor 401, the LSP predictor 402 and the variable rate encoder 1 407. The LSP predictor 402, using current LSPs and LSPs stored in the frame delay unit 403 during the previous frame, predicts the current LSPs as follows $$\hat{F}_i(t) = \sum_{j \in J_i} a_{ij} F_j(t) + \sum_{k \in k_i} b_{ik} F_k(t-1) + c_i,\ i = \overline{1,m}$$

where $F_i(t)$ denotes the i-th LSP for the current frame, $F_i(t-1)$ denotes the i-th LSP for the previous frame, $\hat{F}_i(t)$ denotes the predicted i-th LSP for the current frame, a, b, c are linear prediction coefficients, $J_i$, $K_i$ are some sets of indices. Linear prediction coefficients, and sets of indices, are precomputed using a large speech database to minimize the mean-squared prediction error.

For example if m=10 the corresponding equations have the following form $$F_1(t) = \text{round}(b_{11}F_1(t-1) + b_{12}F_{10}(t-1) + c_1);$$

$$F_{10}(t) = \text{round}(a_{10,1}F_1(t) + b_{10,1}F_9(t-1) + b_{10,2}F_{10}(t-1) + c_{10});$$

$$F_9(t) = \text{round}(a_{9,1}F_{10}(t) + b_{9,1}F_9(t-1) + b_{9,2}F_{10}(t-1) + c_9);$$

$$F_8(t) = \text{round}(a_{8,1}F_9(t) + b_{8,1}F_8(t-1) + b_{8,2}F_9(t-1) + c_8);$$

$$F_7(t) = \text{round}(a_{7,1}F_8(t) + b_{7,1}F_7(t-1) + b_{7,2}F_8(t-1) + c_7);$$

$$F_6(t) = \text{round}(a_{6,1}F_7(t) + b_{6,1}F_6(t-1) + b_{6,2}F_7(t-1) + c_6);$$

$$F_5(t) = \text{round}(a_{5,1}F_6(t) + b_{5,1}F_5(t-1) + b_{5,2}F_6(t-1) + c_5);$$

$$F_4(t) = \text{round}(a_{4,1}F_5(t) + b_{4,1}F_4(t-1) + b_{4,2}F_5(t-1) + c_4);$$

$$F_3(t) = \text{round}(a_{3,1}F_4(t) + b_{3,1}F_3(t-1) + b_{3,2}F_4(t-1) + b_{3,3}F(t-1) + c_3);$$

$$F_2(t) = \text{round}\ (a_{2,1}F_1(t) + a_{2,2}F_3(t) + b_{2,1}F_2(t-1) + b_{2,2}F_1(t-1) + b_{2,3}F_3(t-1) + c_2);$$

where round(x) means rounding x to the nearest integer.

Note that components $F_i$ of the LSP vector depend on each other. So, each estimate $\hat{F}_i$ in the above formulae is calculated based on those components $F_i$ which are correlated with $F_i$ in the most degree. Using the exact values of $F_i$, instead of their estimates in the fight side of the equations, reduces the prediction error. Formulae are ordered by the specific manner. Due to this ordering, calculations are performed in a sequence that uses prediction error values, extracted from the bit stream synthesizer, to restore the exact values $F_i$. Example prediction coefficients are given in the following Table 3.

TABLE 3

| k | $a_{k,1}$ | $a_{k,2}$ | $b_{1k}$ | $b_{2k}$ | $b_{3k}$ | $c_k$ |
|---|---|---|---|---|---|---|
| 1 | | | 0.75 | −0.10 | | 1.75 |
| 2 | 0.65 | 0.70 | 0.45 | −0.45 | −0.25 | 0.06 |
| 3 | 0.65 | | −0.15 | 0.35 | −0.15 | 0.43 |
| 4 | 0.60 | | −0.10 | 0.20 | | 1.15 |
| 5 | 0.55 | | −0.10 | 0.35 | | 1.15 |
| 6 | 0.60 | | −0.10 | 0.45 | | −0.06 |
| 7 | 0.70 | | −0.45 | 0.80 | | 1.35 |
| 8 | 0.60 | | −0.25 | 0.45 | | 1.60 |
| 9 | 0.65 | | −0.40 | 0.55 | | 1.55 |
| 10 | 0.05 | | 0.60 | −0.15 | | 2.25 |

The subtractor 401 produces the residual LSP vector rp. This is the difference vector between the current frame LSPs and the corresponding predicted LSPs. The sequence of LSP differences from the output of the subtractor 401 is component-wise encoded by some variable rate prefix code in the variable rate encoder 1 407.

The second LSP predicting and coding scheme contains frame delay unit 403, the subtractor 404, the sign transformer 1 408 and the variable rate encoder 2 409. The vector of m LSP differences, rd, is generated by subtractor 404 using the formula $$rd_i(t)=F_i(t-1), i=\overline{1,m}.$$

The sign transformer 1 408 analyzes the sum of the vector rd components. If this sum is negative, sign transformer 1 408 inverts all components of the vector rd. The resulting sequence of LSP differences, from the output of sign transformer 1 408, enters variable rate encoder 2 409. Here, the sequence is component-wise coded by a variable rate prefix code.

The third predicting and coding scheme contains the average LSP estimator 405, the subtractor 406, the sign transformer 2 410 and the variable rate encoder 3 411. The vector of m LSP differences, ra at the output of the subtractor 406, is computed by the formula $$ra_i(t)=F_i(t)-\text{average}(F_i), i=\overline{1,m},$$

where average($F_i$) denotes the estimate of the average value for the i-th LSP over a previous time interval, (computed by average LSP estimator 405). The sign transformer 2 410 and the variable rate encoder 3 411 operate analogously to the sign transformer 1 408 and variable rate encoder 2 409 respectively. Generally, encoders 409 and 411 may use the same Huffman code, which differs from the code used by the encoder 1 407. The Huffman codes are precomputed using a large speech database.

At the output of the variable rate encoder 1 407 we have the codeword of length $$L_P=\sum_{i=1}^{m} l_i+N_P,$$

where $l_i$ denotes the codeword length for the i-th component of the vector rp, Np is the number of bits for indicating which predicting scheme has been used.

The outputs of the encoders 409 and 411 are the codewords of lengths $$L_D=\sum_{i=1}^{m} l_i+1+N_D, \text{ and } L_A=\sum_{i=1}^{m} l_i+1+N_A,$$

respectively. One additional bit is needed for pointing to sign inversion, $N_D$ and $N_A$ are the numbers of bits for indicating that the predicting scheme has been used. In one embodiment, the encoding scheme bits have been chosen to be $N_p=1$, $N_A=2$ and $N_D=2$.

The codeword selector 412 finds min{$L_P$, $L_D$, $L_A$}, and the codeword with minimal length, is transferred by selector 412, to the output of the variable rate LSP encoder 202.

A Speech Synthesizer

Figure 5:
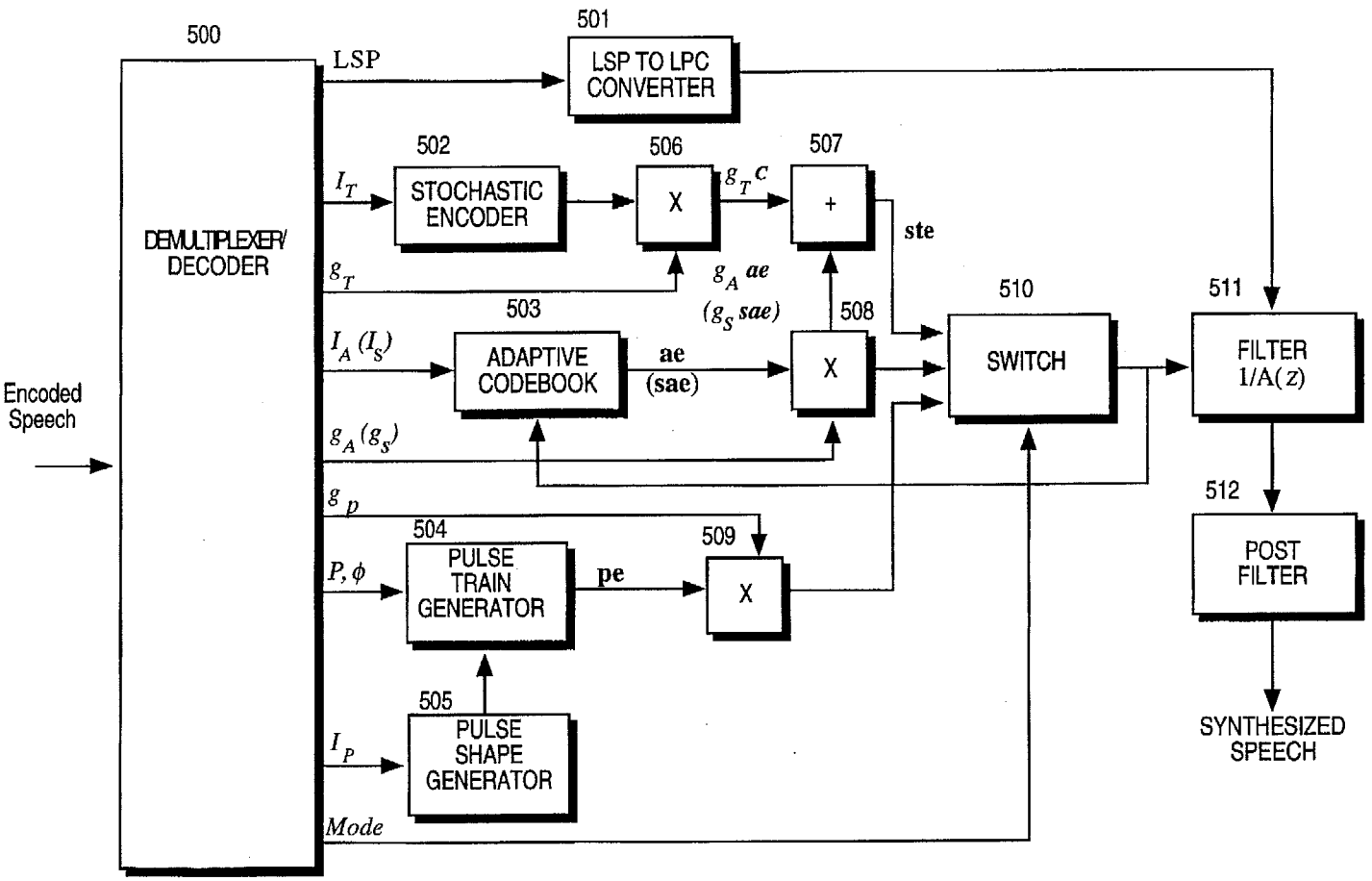
FIG. 5 is a block diagram of a MM-CELP speech synthesizer.

The block diagram in FIG. 5 shows an implementation of a multi-mode trellis encoding and linear prediction (MM-CELP) speech synthesizer. The synthesizer accepts compressed speech data as input and produces a synthesized speech signal. The structure of the synthesizer corresponds to that of the analyzer of FIG. 2, except that trellis encoding has been used.

Input data is passed through a demultiplexer/decoder 500 to obtain a set of line spectrum pairs for the frame (LSPs). The LSP to LPC converter 501 produces a set of linear prediction coefficients (LPCs) for the synthesis filter 511.

For each subframe in the frame, demultiplexer/decoder 500 extracts a search mode, and a corresponding set of excitation parameters (index, gain, pitch, phase), characterizing this mode.

If the mode for a subframe is Pulse, then the pulse shape generator 505 transfers the impulse, with the shape index $I_p$, to the pulse train generator 504. The pulse train generator 504 uses the pitch P, and phase $\phi$, values to produce the excitation vector pe. The vector pe is multiplied in a multiplier 509 by the pulse excitation gain $g_P$, generating a scaled pulse excitation vector $g_P$pe. This $g_P$pe, through the switch 510, controlled by the mode value, is passed to the input of the filter 511, $g_P$pe is also used for updating the content of the ACB.

If the mode for a subframe is ACB, the adaptive codebook 503, addressed by the ACB index $I_A$, produces the excitation vector ae, which is multiplied in a multiplier 508 by the ACB gain $g_A$ to generate the scaled ACB excitation vector $g_A$ae. This vector, through the switch 510, enters filter 511 and is written to the ACB for its innovation.

If the mode for a subframe is SACBS, the adaptive codebook 503, addressed by the shortened ACB index $i_S$, produces the excitation vector sae, that is multiplied, in a multiplier 508, by the shortened ACB gain $g_S$, to generate the scaled shortened ACB excitation vector $g_S$sea.

The stochastic encoder 502 transforms the index $I_T$, into a code word c. A multiplier 506 multiplies c by the gain $g_T$. The adder 507 sums the scaled code vector $g_T$c, with the scaled shortened ACB excitation vector, to produce the excitation vector ste=$g_T$c+$g_S$sae for the processed subframe. The mode signal then causes switch 510 to pass ste through to filter 511. The excitation vector ste is transformed into the synthesized speech by the synthesis filter 511, ste is also used to update the ACB content.

Note that, the output of switch 510 is the excitation corresponding to the selected mode for the subframe. This is used to update the adaptive codebook 503. Also, the output is passed through 1/A(z) filter 511. The output of filter 511 may then be passed through a post-filter 512. If the pre-filter 200 is used in the speech analyzer then the post-filtering of the synthesized speech vector by the post-filter 512 is performed. The output of post-filter 512 is the synthesized speech.

Table 4 gives examples of bit allocation for MM-CELP encoder with the following choice of the parameters: frame length M=240, subframe length L=80, filter order m=10, pulse codebook size=1, ACB size=256, SACB size=16, and SCB size=2048.

An average bit rate of 2270 bps is achieved by using the above-mentioned set of parameters. An additional average bit rate decrease may be attained by pause detecting. In one embodiment, energy test is used for pause detection and only LSP data bits are transmitted during silent subframes, as disclosed in "A multi-mode variable rate CELP coder based on frame classification", Lupini P., Cox N. B., Cuperman V., Proceedings of the 1993 IEEE International Conference on Acoustics, Speech and Signal Processing, pp. 406–409, April 1993.

The average bit rate 1859 bps is obtained under the assumption that voice activity intervals occupy 70% of the whole time. From Table 4 a maximal rate of not more than 2.88 kb/s can be achieved. This fixed bit rate is achieved by introducing two-frames is blocks (a superframe, or superblock), in which not more than three subframes with Pulse or SACBS excitations can exist among a total of six subframes. For each subframe the same bit allocation, as in Table 4, is assumed except for LSP coding. In this case, we use 34-bit independent nonuniform scalar quantization of LSPs, as in the FS-1016 CELP standard.

Figure 6:
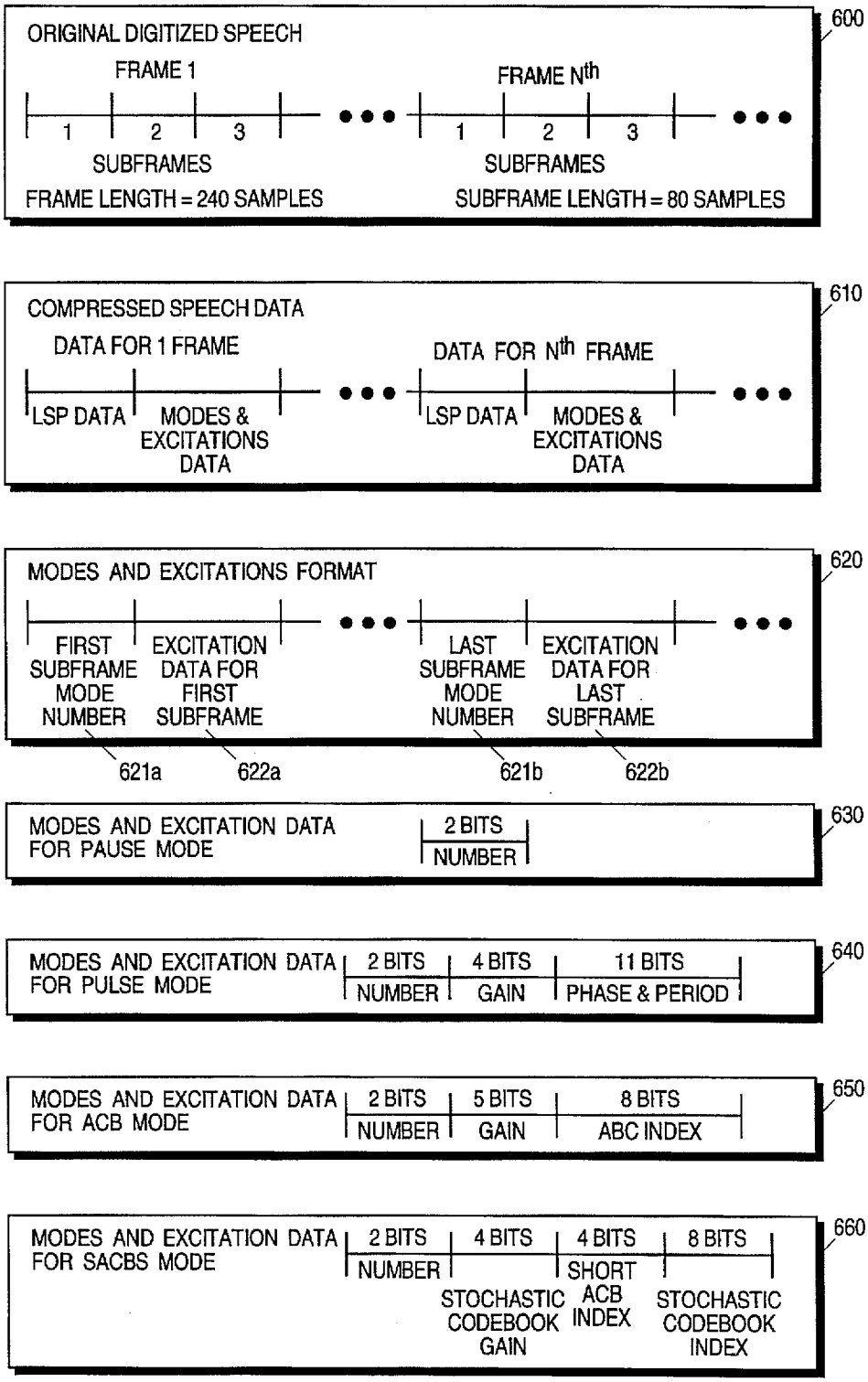
FIG. 6 illustrates example bit stream structures corresponding to encoded speech.

For the purpose of explaining FIG. 6, consider mode numbers which are transmitted using 2 bits per subframe. Since not all sequences of modes are admissible, and modes are observed with unequal frequencies, the average bit rate for transmitting mode numbers may be reduced by almost half, using variable rate or fixed rate lossless data compression methods.

Bit stream 600 represents the original digitized speech containing many frames. Each frame includes three subframes of 80 samples per subframe.

Compressed speech data 610 includes compressed data for each frame in bit stream 600. For example, frame 1 of 600 has been compressed into LSP data, and modes and excitations data for each subframe in frame 1.

Bit stream 620 represents the general format of the modes and excitations for the subframes of a frame. The first bits represent the first subframe's mode number, 621*a*. Immediately following this is the excitation data for this subframe, 622*a*. The last subframe's mode number 621*b*, and the corresponding excitation data, are at the end of the bit stream representing the frame.

Bit streams 630–660 represent the data for various modes in a subframe. All modes are represented in the first two bits of the stream. Bit stream 630 contains the two bit representation for pause mode for a subframe. Bit stream 640 represents the mode and excitation dam for pulse mode. In addition to the mode bits, four bits are used for the gain; and eleven bits are used for the phase and period. Bit stream 650 represents the data for the ACB mode. In addition to the two mode bits, five bits are used for the gain; and eight bits are used for the ACB index. Bit stream 660 represents the data for the SACBS mode. In addition to the first two mode bits, the next four bits represent the stochastic codebook gain. These are followed by the short ACB index of four bits. The next eight bits are the stochastic codebook index.

TABLE 4

| Mode | Pitch and Phase bits | Index (code word number) bits | Gain bits | Total bits for mode | Observed search mode selection frequency | Number of bits per subframe (average or max.) |
|---|---|---|---|---|---|---|
| Pulse | 11 | 0 | 4 | 15 | 10% | 1.5 |
| ACB | — | 7 | 0 + 4 | 12 | 70% | 8.4 |
| SACBT | — | 4 + 11 | | 19 | 20% | 3.8 |
| Average number of bits for excitation coding | | | | | | 13.7 |
| Maximal number of bits for excitation coding (3*19 + 3*13)/6 | | | | | | 15.5 |
| Average number of bits for LSP coding 21/3 | | | | | | 7.0 |
| Maximal number of bits for LSP coding 34/3 | | | | | | 11.3 |
| Mode number | | | | | | 2.0 |
| Mode number (maximal) | | | | | | 2.0 |
| Total average number of bits per subframe | | | | | | 22.7 |
| Total maximal number of bits per subframe | | | | | | 28.8 |
| Average bit rate without pause detection | | | | | | 2270 bps |
| Maximal bit rate | | | | | | 2880 bps |
| Bit rate on pauses (21/3 + 2)*100 | | | | | | 900 bps |
| Average bit rate with pause detection (30%*900 + 70%*2270) | | | | | | 1859 bps |

Therefore, a more than twice (≦2400 bps) the bit rate decrease is attained by the application of the present invention.

Example Bit Allocations for Enclosed Speech

An example of bit allocation and a data bit stream structure corresponding to the above bit allocations are shown in FIG. 6. This figure demonstrates one possible embodiment of the present invention. It is clear to one skilled in this art that using more sophisticated coding means, at the output of the analyzer one can reduce the number of bits in the present bit allocation. This will additionally decrease the bit rate without any loss in the synthesized speech quality.

Variable Rate Encoding

Encoded excitation data for various modes contains quantized gains and pitches which change slowly from one subframe to another. Any known method for variable rate lossless encoding of these values or their differences may be used for reducing total bit rate for the above-described speech compression system. For example, to achieve greater speech compression (bit rate reducing) pitch and gain differences may be encoded still further by suitable lossless encoding, such as Huffman encoding, use of a Shannon-Fano tree, or by arithmetic (lossless) encoding. As is well known, Huffman codes are minimum redundancy variable length codes, as described by David A. Huffman in an article entitled "Method for Construction of Minimum Redundancy Codes", in Proceedings of the I.R.E., 1952, Volume 40, pages 1098 to 1101. Shannon-Fano encoding makes use of variable length codes, and was described by Gilbert Held in the treatise "Data Compression, Techniques and Applications, Hardware and Software Considerations", 2d Edition, 1987, Wiley & Sons, at pages 107 to 113. See Mark Nelson, "The Data Compression Book", 1992, M&T Publishing, Inc., pages 123–167, for a discussion of lossless encoding.

Moreover some kinds of joint coding for excitation parameters may be used to reduce the number of bits in the bit stream. For example, consider joint phase and period encoding for the pulse excitation mode. Let a frame size be equal to 80. Then we have 80 possible phase values. Since a typical original speech period (pitch) is geater than 20, we have 60 different possible phase values. If we take into account the fact that sum phase + period is less than or equal to 80, then after simple calculations we get only 1910 different possible pairs (phase, period). So 11 bits will be enough for lossless coding of these pairs. Separate pitch and phase coding requires at least 7 bits for phase and 6 bits for pitch, i.e. 13 bits. So, joint phase and pitch coding for pulse sequences saves 2 bits per frame.

An improved method and apparatus for compressing speech has been described.

What is claimed is:

1. A method of communicating digitized voice signals in a computer system, said computer system including an analyzer coupled to a synthesizer, said method comprising the steps of:

dividing said digitized voice signals into a plurality of frames, each frame of said plurality of frames including a plurality of subframes;

for at least one frame of said plurality of frames performing the steps of:

calculating a set of linear prediction coefficients (LPCs) corresponding to said frame; and for at least one subframe in said frame performing the steps of:

determining a previous search mode for a previous subframe;

selecting from a plurality of modes a currently selected set of modes based on said previous search mode;

selecting a current search mode from said currently selected set of modes;

encoding a set of selected parameters for said current search mode;

transmitting said selected parameters from said analyzer to said synthesizer;

decoding said selected parameters according to said current search mode; and generating a synthesized voice signal from said selected parameters, said synthesized voice signal corresponding to said digitized voice signals.

2. The method of claim 1 wherein said step of selecting a current search mode includes the steps of:

generating a match value for each mode in said currently selected set of modes;

weighting each match value according to a predetermined weighting factor; and selecting the mode in said currently selected set of modes having a maximum weighted match value as said current search mode.

3. The method of claim 1 wherein said currently selected set of modes includes a pulse mode, an adaptive codebook mode and a pause mode, if said previous search mode is said pulse mode.

4. The method of claim 1 wherein said currently selected set of modes includes a pulse mode, a stochastic codebook search mode, and a pause mode, if said previous search mode is an adaptive codebook mode.

5. The method of claim 1 wherein said currently selected set of modes includes a pulse mode, an adaptive codebook mode, and a pause mode, if said previous search mode is a stochastic codebook mode.

6. The method of claim 1 wherein said currently selected set of modes includes a pulse mode, and a pause mode, if said previous search mode is said pause mode.

7. The method of claim 1 wherein said step of selecting a current search mode from said currently selected set of modes includes the steps of:

generating a match value for each mode in said currently selected set of modes in said currently selected set of modes, each of said modes requiring a number of bits when used by said analyzer;

testing the match values in increasing order based on the number of bits required for the corresponding modes; and selecting the first of said modes that complies with a predetermined error threshold as said current search mode.

8. A method of encoding digitized voice signals in a computer system, wherein said digitized voice signals are divided into a plurality of frames, each frame of said plurality of frames including a plurality of subframes, said method comprising the steps of:

for at least one subframe in said frame performing the steps of:

determining a previous search mode for a previous subframe;

selecting from a plurality of modes a currently selected set of modes based on said previous search mode;

selecting a current search mode from said currently selected set of modes; and encoding a set of selected parameters for said current search mode.

9. The method of claim 8 wherein said step of selecting a current search mode from said currently selected set of modes includes the steps of:

generating a match value for each mode in said currently selected set of modes;

weighting each match value according to a predetermined weighting factor; and selecting the mode in said currently selected set of modes having a maximum weighted match value as said current search mode.

10. The method of claim 8 wherein said currently selected set of modes includes a pulse mode, an adaptive codebook mode and a pause mode, if said previous search mode is said pulse mode.

11. The method of claim 8 wherein said currently selected set of modes includes a pulse mode, a stochastic codebook search mode, and a pause mode, if said previous search mode is an adaptive codebook mode.

12. The method of claim 8 wherein said currently selected set of modes includes a pulse mode, an adaptive codebook mode, and a pause mode, if said previous search mode is a stochastic codebook mode.

13. The method of claim 8 wherein said currently selected set of modes includes a pulse mode, and a pause mode, if said previous search mode is said pause mode.

14. The method of claim 8 wherein said step of selecting a current search mode from said currently selected set of modes includes the steps of:

generating a match value for each mode in said currently selected set of modes, each of said modes requiring a number of bits when used by said analyzer;

testing the match values in increasing order based on the number of bits required for the corresponding modes; and selecting the first of said modes that complies with a predetermined error threshold as said current search mode.

15. A method of encoding a current subframe representing a portion of a digitized voice signal, said method comprising the steps of:

obtaining information regarding a previously selected excitation search mode used for a previous subframe;

selecting from a plurality of excitation search modes a set of more than one admissible excitation search modes based upon said information, each excitation search mode in said plurality of excitation search modes corresponding to one of a plurality of sets of excitation parameters;

selecting one of said set of more than one admissible excitation search modes as a current excitation search mode;

selecting one of said plurality of sets of excitation parameters as a currently selected set of excitation parameters based upon said current excitation search mode, each set of excitation parameters in said plurality of sets of excitation parameters produced by a corresponding circuit; and encoding said current subframe using said current excitation search mode and said currently selected set of excitation parameters.

16. The method of claim 15 further comprising the steps of:

enabling the circuit corresponding to the current excitation search mode; and disabling circuits that do not correspond to the current excitation search mode.

17. The method of claim 15, wherein said step of selecting from said plurality of excitation search modes a set of more than one admissible excitation search modes includes the steps of:

including, in said set of admissible excitation search modes a pulse mode, a stochastic codebook search mode, and a pause mode, if said previous subframe excitation search mode is an adaptive codebook mode;

including, in said set of admissible excitation search modes said pulse mode, said adaptive codebook mode, and said pause mode, if said previous subframe excitation search mode is said stochastic codebook search mode; and including, in said set of admissible excitation search modes said pulse mode and said pause mode, if said previous subframe excitation search mode is said pause mode.

18. An apparatus for transforming a voice signal into an encoded signal comprising:

a plurality of circuits, each circuit in said plurality of circuits for performing a different excitation search technique to generate an excitation and a set of parameters for use in encoding said voice signal;

a comparator and controller circuit for selecting a current excitation search technique from said different excitation search techniques, said comparator and controller circuit selects said current excitation search technique by selecting a subset of said different excitation search techniques based on a previous excitation search technique used for encoding a previously processed subframe of said voice signal;

a selector of parameters coupled to said comparator and controller circuit for selecting as a currently selected set of parameters the set of parameters generated by the one of said plurality of circuits that performs said current excitation search technique;

a selector of excitations coupled to said comparator and controller circuit for selecting as a currently selected excitation the excitation generated by the one of said plurality of circuits that performs said current excitation search mode; and an encoder coupled to said selection circuit for encoding said voice signal using said currently selected excitation and set of parameters.

19. The apparatus of claim 18 wherein said plurality of circuits comprises:

a pulse train analyzer;

an adaptive codebook analyzer; and a stochastic codebook analyzer.

20. The apparatus of claim 18 wherein each of said plurality of circuits generates a match value and said comparator and controller circuit selects said current excitation search technique from said subset of said different excitation search techniques based upon said match values.

21. A method of encoding digitized voice signals, wherein said digitized voice signals are divided into a plurality of frames, said method comprising steps of:

dividing each of a plurality of frames into subframes; and employing a single search mode for a subframe by performing the steps of:

determining a previous search mode for a previous subframe, selecting from a plurality of modes a currently selected set of modes based on said previous search mode, selecting a current search mode from said currently selected set of modes, and encoding no more than one set of parameters for the subframe, the one set of parameters corresponding to said current search mode.

22. The method of claim 21, wherein said step of selecting from a plurality of modes a currently selected set of modes based on said previous search mode includes the steps of:

including, in said currently selected set of modes a pulse mode, a stochastic codebook search mode, and a pause mode, if said previous search mode is an adaptive codebook mode;

including, in said currently selected set of modes said pulse mode, said adaptive codebook mode, and said pause mode, if said previous search mode is said stochastic codebook search mode; and including, in said currently selected set of modes said pulse mode and said pause mode, if said previous search mode is said pause mode.

23. The method of claim 21 wherein said step of selecting from a plurality of modes a currently selected set of modes based on said previous search mode includes the steps of:

generating a match value for each mode in said currently selected set of modes;

weighting each match value according to a predetermined weighting factor; and selecting the mode in said currently selected set of modes having a maximum weighted match value as said current search mode.

24. A method of encoding digitized voice signals in a computer system, wherein said digitized voice signals are divided into a plurality of frames, each frame of said plurality of frames including a plurality of subframes, said method comprising the steps of:

for at least one subframe in said frame performing the steps of:

determining a previous search mode for a previous subframe;

determining a currently selected set of search modes based on said previous search mode, the currently selected set of search modes including at least two search modes;

dynamically selecting a current search mode from said currently selected set of search modes; and encoding a set of selected parameters for said current search mode.

25. The method of claim 24 wherein said step of dynamically selecting a current search mode from said currently selected set of search modes includes the steps of:

generating a match value for each mode in said currently selected set of modes;

weighting each match value according to a predetermined weighting factor; and selecting the mode in said currently selected set of modes having a maximum weighted match value as said current search mode.

* * * * *